US008777391B2

(12) United States Patent
Okada et al.

(10) Patent No.: US 8,777,391 B2
(45) Date of Patent: Jul. 15, 2014

(54) METHOD FOR FORMING IMAGE, METHOD FOR PRODUCING FABRIC HAVING IMAGE, AND TREATMENT AGENT

(75) Inventors: Goro Okada, Nagoya (JP); Reiko Nishikawa, Kariya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 398 days.

(21) Appl. No.: 13/038,462

(22) Filed: Mar. 2, 2011

(65) Prior Publication Data

US 2011/0242189 A1 Oct. 6, 2011

(30) Foreign Application Priority Data

Mar. 31, 2010 (JP) ..... 2010-082895

(51) Int. Cl.
*B41J 2/01* (2006.01)

(52) U.S. Cl.
USPC ..... 347/100

(58) Field of Classification Search
USPC ..... 347/100
See application file for complete search history.

(56) References Cited

U.S. PATENT DOCUMENTS

| | | | | |
|---|---|---|---|---|
| 4,954,395 | A | 9/1990 | Hasegawa et al. | |
| 6,211,265 | B1 * | 4/2001 | Ohta et al. | 523/160 |
| 6,277,498 | B1 | 8/2001 | Endo et al. | |
| 7,265,164 | B2 * | 9/2007 | Komatsu et al. | 523/160 |
| 7,335,237 | B2 * | 2/2008 | Watanabe | 8/445 |
| 2002/0028319 | A1 | 3/2002 | Hirabayashi et al. | |
| 2004/0263598 | A1 * | 12/2004 | Watanabe | 347/101 |
| 2007/0104899 | A1 | 5/2007 | Pearl et al. | |
| 2008/0024536 | A1 * | 1/2008 | Hirano et al. | 347/13 |
| 2008/0233363 | A1 | 9/2008 | Goto | |
| 2009/0191383 | A1 * | 7/2009 | Kluge et al. | 428/195.1 |
| 2010/0091052 | A1 | 4/2010 | Ogawa et al. | |

FOREIGN PATENT DOCUMENTS

| | | | | |
|---|---|---|---|---|
| JP | 3031594 B | | 5/1991 | |
| JP | 09-267549 A | | 10/1997 | |
| JP | 11-342669 A | | 12/1999 | |
| JP | 2003-145920 A | | 5/2003 | |
| JP | 2004-291461 | | 10/2004 | |
| JP | 2006-152454 A | | 6/2006 | |
| JP | 2008075215 A | * | 4/2008 | D06B 11/00 |
| JP | 2009-030014 A | | 2/2009 | |
| JP | 2009-209493 | | 9/2009 | |
| WO | 2009/154101 A1 | | 12/2009 | |

OTHER PUBLICATIONS

Anonymous: "Products List: PAA Series", Nittobo, 2009 p. 5pp, XP002651079, retrieved from the Internet: URL: http://www.nittobo.co.jp/english/chemical/pdf/productslist.pdf [retrieved on Jul. 15, 2011], pp. 1-2.

EP Extended Search Report dated Sep. 26, 2011, corresponding Application No. 11153956.5.

JP Office Action mailed Jun. 28, 2012, JP Appln. 2010-082895, partial English translation.

* cited by examiner

*Primary Examiner* — Laura Martin
(74) *Attorney, Agent, or Firm* — Banner & Witcoff, Ltd.

(57) ABSTRACT

Provided is an image forming method for forming an image on fabric including a treatment step of applying a treatment agent on fabric, an image printing step of printing an image on a treatment agent-applied area with an ink, and a heat-fixing step of heat-fixing the ink on the fabric. The treatment agent used in the treatment step includes at least one of the following component A and the following component B:

Component A: a diallyldimethylammonium chloride-sulfur dioxide copolymer

Component B: a mixture of an allylamine-diallylamine copolymer and sodium chloride.

16 Claims, 4 Drawing Sheets

METHOD FOR FORMING IMAGE, METHOD FOR PRODUCING FABRIC HAVING IMAGE, AND TREATMENT AGENT

CROSS-REFERENCE TO RELATED APPLICATION

This application claims priority from Japanese Patent Application No. 2010-82895 filed on Mar. 31, 2010. The entire subject matter of the Japanese Patent Application is incorporated herein by reference.

BACKGROUND

A printing method for printing an image on fabric such as a T-shirt and a bathing suit by ejecting an ink by an ink-jet method has been proposed.

However, in the case of printing a color image by the printing method, improvement of color developing properties is demanded. Further, with respect to the fabric to be printed by the printing method, there is a demand for reduction of color fading and peeling due to washing (washing fastness).

SUMMARY

An image forming method for forming an image on fabric comprises:

a treatment step of applying a treatment agent on fabric;

an image printing step of printing an image on a treatment agent-applied area with an ink;

and a heat-fixing step of heat-fixing the ink on the fabric, wherein the treatment agent used in the treatment step comprises at least one of the following component A and the following component B:

Component A: a diallyldimethylammonium chloride-sulfur dioxide copolymer

Component B: a mixture of an allylamine-diallylamine copolymer and sodium chloride.

A producing method for producing fabric having an image comprises a step of forming an image on the fabric by the aforementioned image forming method. According to the producing method, fabric having an image with higher color developing properties and washing fastness may be obtained.

A treatment agent used for forming an image on fabric comprises at least one of the component A and the component B. The component A is added so as to satisfy the following condition (i) and the component B is added so as to satisfy the following condition (ii):

(i) $x \leq$ about 10

(ii) $y \leq$ about 10 x: an amount of the component A relative to a total amount of the treatment agent (wt %)

y: an amount of the component B relative to a total amount of the treatment agent (wt %).

DETAILED DESCRIPTION

Figure 1A:
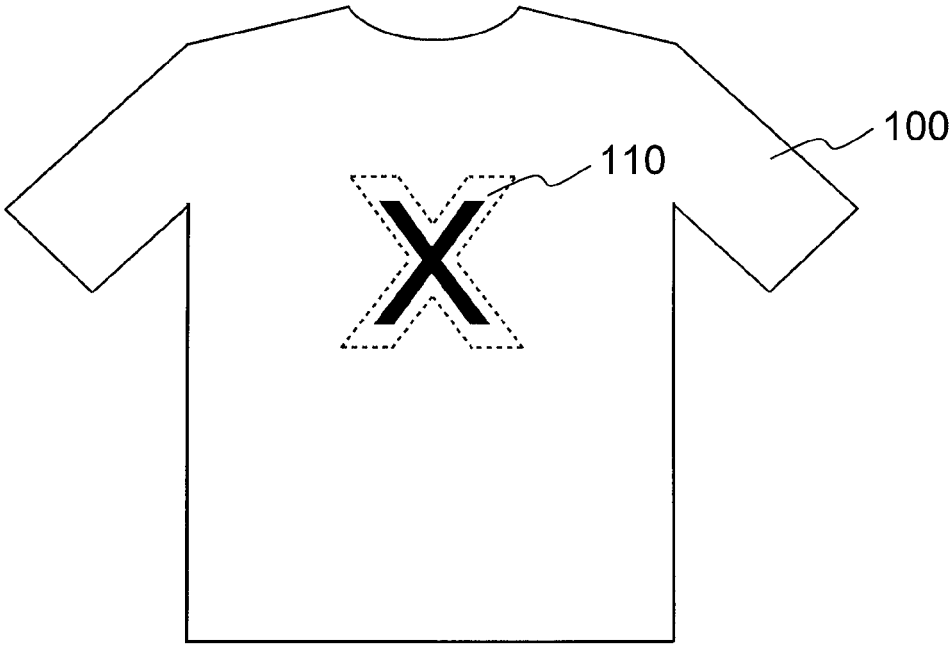
FIG. 1A is a view showing an example of image forming by the image forming method.

As described above, the image forming method comprises a treatment step, an image printing step, and a heat-fixing step. In the image forming method, the order of the treatment step and the image printing step is not limited and either one of the steps may be performed prior to the other or the steps may be performed simultaneously. The heat-fixing step is performed after the image printing step. The image forming method may comprise, for example, the heat-treatment step and the compression step, which will be described below, besides the aforementioned three steps.

<Treatment Step>

The treatment step is a step of applying a treatment agent on fabric. The treatment agent used for the treatment step is the aforementioned treatment agent.

Examples of the fabric include clothes such as T-shirts, bathing suits, sweat shirts, and the like; bags; shoes; slippers; socks; furniture such as sofas and the like; fabric goods such as flags and the like; and the like. The fabric includes both woven fabric and knitted fabric. The material of the fabric may be synthetic fiber although natural fiber is also applicable. When the material of the fabric is synthetic fiber, properties such as strength, stretchability, water repellency, lightness, and the like of the fabric may be adjusted easily. Further, since water absorbency and moisture absorbency of the synthetic fiber are lower than those of the natural fiber and a quick-drying property of the synthetic fiber is higher than that of the natural fiber, in the case of clothes, it is possible to keep on the clothes without being sticky even after sweating and may prevent body temperature decrease due to sweating. Therefore, the synthetic fiber is widely used for sportswears, climbing clothing, and the like. Examples of the synthetic fiber include polyester, nylon, acrylic, and the like, and may be polyester. When an image is formed on polyester without using a treatment agent, color developing properties as well as washing fastness are not favorable. In contrast, according to the image forming method, the color developing properties and the washing fastness are improved by applying the treatment agent comprising at least one of the component A and the component B on polyester at the time of forming an image on polyester. Examples of the natural fiber include cotton, silk, and the like. The fabric may be blended fabric that is spun with a plurality of the aforementioned fabric. In the image forming method, for example, an image may be formed on fabric that is formed into a sheet or a thin film, and the fabric may be sewn to a piece of clothes or a fabric good.

As described above, the treatment agent comprises at least one of the component A and the component B. The treatment agent may comprise components other than the component A and the component B. A commercial product may be used as the component A and an example thereof includes "Danfix®-303" produced by Nitto Boseki Co., Ltd. A commercial product may be used as the component B and an example thereof includes "Danfix®-PAA" produced by Nitto Boseki Co., Ltd. It is to be noted that these commercial products have been marketed as the aftertreatment agents that are used after dyeing and the use of them for printing an image on fabric has not been known.

In the treatment agent, the amount of the component A may be about 0.5 wt % or less from the viewpoint of the washing fastness. The amount of the component A can be more than about 0.5 wt % from the viewpoint of the color developing properties. From the viewpoint of both the washing fastness and the color developing properties, the amount of the component A may be in the range from about 0.1 wt % to about 10 wt % or in the range from about 0.5 wt % to about 4 wt %.

In the treatment agent, the amount of the component B is preferably as large as possible from the viewpoint of the color developing properties. The amount may be about 0.3 wt % or more, or about 0.5 wt % or more.

From the viewpoint of the washing fastness, the amount of the component B is preferably as small as possible provided that the amount is about 0.5 wt % or more. The amount of the component B is preferably as small as possible from the viewpoint of yellowing, and may be about 0.3 wt % or less. From the viewpoint of the balance of the washing fastness, the color developing properties, and the yellowing, the amount of the component B may be in the range from about 0.3 wt % to about 10 wt %.

In the case where the treatment agent comprises both the component A and the component B, from the viewpoint of the balance of the washing fastness, the color developing properties, and the yellowing, the amount of the component A may be about 0.5 wt % and the amount of the component B may be about 0.3 wt %.

The treatment agent may further comprise water. The water may be ion-exchange water or pure water. The amount of the water to be added relative to the total amount of the treatment agent may be, for example, the balance of the treatment agent, excluding other components.

The treatment agent may further comprise a water-soluble organic solvent. A conventionally known water-soluble organic solvent may be used as the water-soluble organic solvent. Examples of the water-soluble organic solvent include polyalcohols, polyalcohol derivatives, alcohols, amides, ketones, ketoalcohols, ethers, nitrogen-containing solvents, sulfur-containing solvents, propylene carbonate, ethylene carbonate, 1,3-dimethyl-2-imidazolidinone, and the like. Examples of the polyalcohols include glycerin, ethylene glycol, diethylene glycol, propylene glycol, butylene glycol, hexylene glycol, triethylene glycol, polyethylene glycol, dipropylene glycol, tripropylene glycol, polypropylene glycol, trimethylolpropane, 1,5-pentanediol, 1,2,6-hexanetriol, and the like. Examples of the polyalcohol derivatives include ethylene glycol methyl ether, ethylene glycol ethyl ether, ethylene glycol n-propyl ether, ethylene glycol n-butyl ether, diethylene glycol methyl ether, diethylene glycol ethyl ether, diethylene glycol n-propyl ether, diethylene glycol n-butyl ether, diethylene glycol n-hexyl ether, triethylene glycol methyl ether, triethylene glycol ethyl ether, triethylene glycol n-propyl ether, triethylene glycol n-butyl ether, propylene glycol methyl ether, propylene glycol ethyl ether, propylene glycol n-propyl ether, propylene glycol n-butyl ether, dipropylene glycol methyl ether, dipropylene glycol ethyl ether, dipropylene glycol n-propyl ether, dipropylene glycol n-butyl ether, tripropylene glycol methyl ether, tripropylene glycol ethyl ether, tripropylene glycol n-propyl ether, tripropylene glycol n-butyl ether, and the like. Examples of the alcohols include methyl alcohol, ethyl alcohol, n-propyl alcohol, isopropyl alcohol, n-butyl alcohol, sec-butyl alcohol, isobutyl alcohol, tert-butyl alcohol, benzyl alcohol, and the like. Examples of the amides include dimethylformamide, dimethylacetamide, and the like. Examples of the ketones include acetone and the like. Examples of the ketoalcohols include diacetone alcohol and the like. Examples of the ethers include tetrahydrofuran, dioxane, and the like. Examples of the nitrogen-containing solvents include pyrrolidone, 2-pyrrolidone, N-methyl-2-pyrrolidone, cyclohexylpyrrolidone, triethanolamine, and the like. Examples of the sulfur-containing solvents include thiodiethanol, thiodiglycol, thiodiglycerol, sulfolane, dimethyl-sulfoxide, and the like. The amount of the water-soluble organic solvent to be added relative to the total amount of the treatment agent is not particularly limited. One of the water-soluble organic solvents may be used alone or two or more of them may be used in combination.

The treatment agent may further comprise a conventionally known additive(s), if necessary. Examples of the additive include a surfactant, a pH adjuster, a viscosity modifier, a surface tension modifier, an antioxidant, a mildewproofing agent, and the like. Examples of the viscosity modifier include polyvinyl alcohol, cellulose, and a water-soluble resin, and the like.

In the treatment step, the treatment agent may be applied by an ink-jet method, a spraying method, a stamping method, a brushing method, a rolling method, or the like.

Figure 1B:
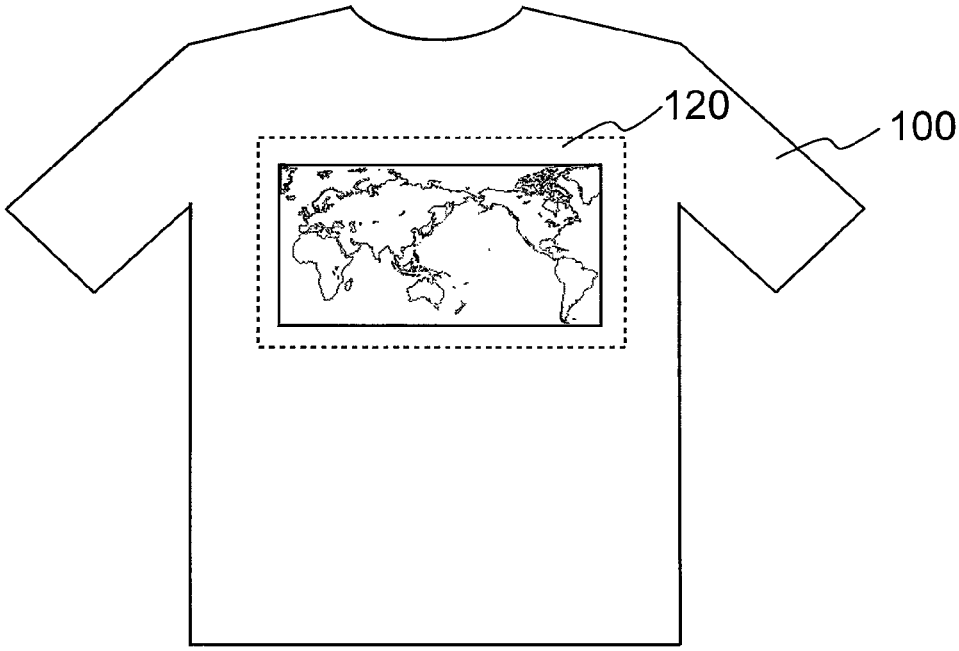
FIG. 1B is a view showing another example of image forming by the image forming method.

In the treatment step, the treatment agent may be applied to the whole or a part of an image forming side of the fabric. In the case of applying the treatment agent to a part of the image forming side of the fabric, the treatment agent is applied to at least an area to be printed with an ink. Hereinafter, this area is referred to as a treatment agent-applied area. In the case of applying the treatment agent to a part of the image forming side of the fabric, the treatment agent-applied area may be larger than the area to be printed. For example, as shown in FIG. 1A, in the case of printing the letter "X" on fabric (a T-shirt in this example) 100, the treatment agent may be applied to form a treatment agent-applied area 110 having a line width wider than that of the letter. Further, for example, as shown in FIG. 1B, in the case of printing an image on the fabric (T-shirt) 100, the treatment agent may be applied to form a treatment agent-applied area 120 that is larger than the image.

<Heat-Treatment Step and Compression Step>

The image forming method may comprise at least one of a heat-treatment step and a compression step. The heat-treatment step is a step of heat-treating the treatment agent-applied area to dry and the compression step is a step of compressing the treatment agent-applied area. The heat-treatment step and the compression step are performed after the treatment step. The heat-treatment may be performed using, for example, a hot pressing machine, an oven, a conveyor belt oven, or the like, which is commercially available. In the case of using the hot pressing machine, the heat-treatment may be performed in the state where a Teflon® sheet with a smooth surface is placed on the treatment agent-applied area. Thereby, fuzz of the fabric may be suppressed, and the image printing step may be performed more smoothly when the image printing step is performed after the heat-treatment step and/or the compression step, for example. The temperature of the heat-treatment is, for example, in the range from about 160° C. to about 185° C., although it is not particularly limited. The compression treatment may be performed under the same conditions as those of the heat-treatment using a commercially available hot pressing machine.

<Image Printing Step>

The image printing step is a step of printing an image on the treatment agent-applied area with an ink.

The ink used in the image printing step is not particularly limited and a commercially available ink may be used, for example. The ink may be a water-based ink comprising a pigment, water, a water-soluble resin emulsion, and a water-soluble organic solvent, although an ink comprising a dye is also applicable.

Examples of the pigment include, but not limited to, carbon black, inorganic pigments, organic pigments, and the like. Examples of the carbon black include furnace black, lamp black, acetylene black, channel black, and the like. Examples of the inorganic pigments include titanium oxide, an iron oxide inorganic pigment, a carbon black inorganic pigment, and the like. Examples of the organic pigments include azo pigments such as azo lake, an insoluble azo pigment, a condensed azo pigment, a chelate azo pigment, and the like; polycyclic pigments such as a phthalocyanine pigment, a perylene and perynone pigment, an anthraquinone pigment, a quinacridone pigment, a dioxazine pigment, a thioindigo pigment, an isoindolinone pigment, a quinophthalone pigment, and the like; dye lake pigments such as a basic dye lake pigment, an acid dye lake pigment, and the like; a nitro pigment; a nitroso pigment; an aniline black daylight fluorescent pigment; and the like. Further, other pigments may be used as long as they are dispersible to an aqueous phase. Examples of the pigments include C. I. Pigment Black 1, 6, and 7; C. I. Pigment Yellow 1, 2, 3, 12, 13, 14, 15, 16, 17, 55, 73, 74, 75, 83, 93, 94, 95, 97, 98, 114, 128, 129, 138, 150, 151, 154, 180, 185, and 194; C. I. Pigment Orange 31 and 43; C. I. Pigment Red 2, 3, 5, 6, 7, 12, 15, 16, 48, 48:1, 53:1, 57, 57:1, 112, 122, 123, 139, 144, 146, 149, 166, 168, 175, 176, 177, 178, 184, 185, 190, 202, 221, 222, 224, and 238; C. I. Pigment Violet 196; C. I. Pigment Blue 1, 2, 3, 15, 15:1, 15:2, 15:3, 15:4, 16, 22, and 60; C. I. Pigment Green 7 and 36; and the like.

The amount of the pigment to be added relative to the total amount of the water-based ink (the proportion of the pigment in the water-based ink) is not particularly limited and may be decided suitably depending on a desired optical density or color, for example. The proportion of the pigment in the water-based ink is, for example, in the range from about 0.1 wt % to about 20 wt %, and in the range from about 3.0 wt % to about 10 wt %.

The water may be ion-exchange water or pure water. The amount of the water to be added relative to the total amount of the water-based ink (the proportion of the water in the water-based ink) is decided suitably depending on, for example, desired ink properties. The amount of the water to be added may be, for example, the balance of the ink, excluding other components.

The water-soluble resin emulsion, for example, has a function of dispersing the pigment in the ink and serves as a binder for fixing the pigment on fabric. Particularly, in the case where the image printing step is performed by an ink-jet method, the washing fastness may be improved by adding the water-soluble resin emulsion.

Various emulsions each having a glass-transition temperature of about 0° C. or lower may be employed as the water-soluble resin emulsion. Examples of the water-soluble resin emulsions include acrylic-based emulsions, urethane-based emulsions, polyester-based emulsions, polystyrene-based emulsions, combinations thereof, and the like. Among them, acrylic-based emulsions may be employed.

As the water-soluble resin emulsion, any of anionic emulsions, cationic emulsions, and nonionic emulsions may be employed. Further, no particular limitation is imposed on the properties of the water-soluble resin emulsion, and any of micro-emulsions, gloss emulsions, reactive emulsions, room temperature crosslinkable emulsions, and double-layered emulsions may be employed, for example. The average volume particle size of the resin fine particles composing the water-soluble resin emulsion is, for example, in the range from about 10 nm to about 200 nm, and in the range from about 50 nm to about 150 nm.

The amount of the water-soluble resin emulsion to be added relative to the total amount of the water-based ink (hereinafter, may also be referred to as "the proportion of the water-soluble resin emulsion in the water-based ink") may be in the range from about 4 wt % to about 15 wt %. By adjusting the proportion of the water-soluble resin emulsion to about 4 wt % or more, dispersibility of the pigment in the ink and fixability of the pigment to the fabric may be improved, and in particular, the washing fastness may further be improved. Further, by adjusting the proportion of the water-soluble resin emulsion to about 15 wt % or less, a water-based ink with higher ejection stability may be obtained, for example, in the case where the image printing step is performed by an ink-jet method.

In the case where the image printing step is performed by an ink-jet method, the water-soluble organic solvent serves as a humectant that prevents an ink from drying at a nozzle tip portion of an ink-jet head, for example.

Examples of the humectant include, but not limited to, lower alcohols such as methyl alcohol, ethyl alcohol, n-propyl alcohol, isopropyl alcohol, n-butyl alcohol, sec-butyl alcohol, tert-butyl alcohol, and the like; amides such as dimethylformamide, dimethylacetamide, and the like; ketones such as acetone, and the like; ketoalcohols such as diacetone alcohol, and the like; ethers such as tetrahydrofuran, dioxane, and the like; polyalcohols such as polyalkylene glycol, alkylene glycol, glycerin, and the like; 2-pyrrolidone; N-methyl-2-pyrrolidone; 1,3-dimethyl-2-imidazolidinone; and the like. Examples of the polyalkylene glycol include, but not limited to, polyethylene glycol, polypropylene glycol, and the like. Examples of the alkylene glycol include, but not limited to, ethylene glycol, propylene glycol, butylene glycol, diethylene glycol, triethylene glycol, dipropylene glycol, tripropylene glycol, thiodiglycol, hexylene glycol, and the like. Among them, for example, the humectant may be polyethylene glycol or diethylene glycol. One of the humectants may be used alone or two or more of them may be used in combination.

The water-based ink may further comprise a conventionally known additive(s), if necessary. Examples of the additive include a surfactant, a viscosity modifier, a surface tension modifier, a mildewproofing agent, and the like. Examples of the viscosity modifier include, but not limited to, polyvinyl alcohol, cellulose, a water-soluble resin, and the like.

The water-based ink may be prepared, for example, by uniformly mixing the pigment, water, the water-soluble resin emulsion, the water-soluble organic solvent, and optionally other added components by a conventionally known method, and then removing sediments with a filter or the like.

In the case of printing an image on polyester with the ink comprising a dye, the polyester may be dyed under high temperature conditions (for example, in the range from about 120° C. to about 130° C.) using an ink comprising a dispersive dye. Although the dispersive dye is not soluble or hardly soluble in water, the dispersive dye is used in the condition where it is micronized and dispersed in water using a dispersant (a surfactant).

The image printing step may comprise a base area forming step and an image printing step. The base area forming step is a step of forming a base area on the treatment agent-applied area with a first ink and the image printing step is a step of printing an image on the base area with a second ink. A white ink may be used as the first ink and a color ink may be used as the second ink. For example, a white ink comprising a white pigment such as titanium oxide or the like may be used as the white ink. When an image is directly printed on fabric of deep color (for example, black) with color inks, the color developing properties may occasionally be decreased. On the other hand, when an image is printed on the base area with color inks after forming a base area with a white ink, a color image with higher color developing properties may be formed even on fabric of deep color. When an image is printed on fabric of light color (for example, white), the base area forming step is not necessarily performed.

Figure 2:
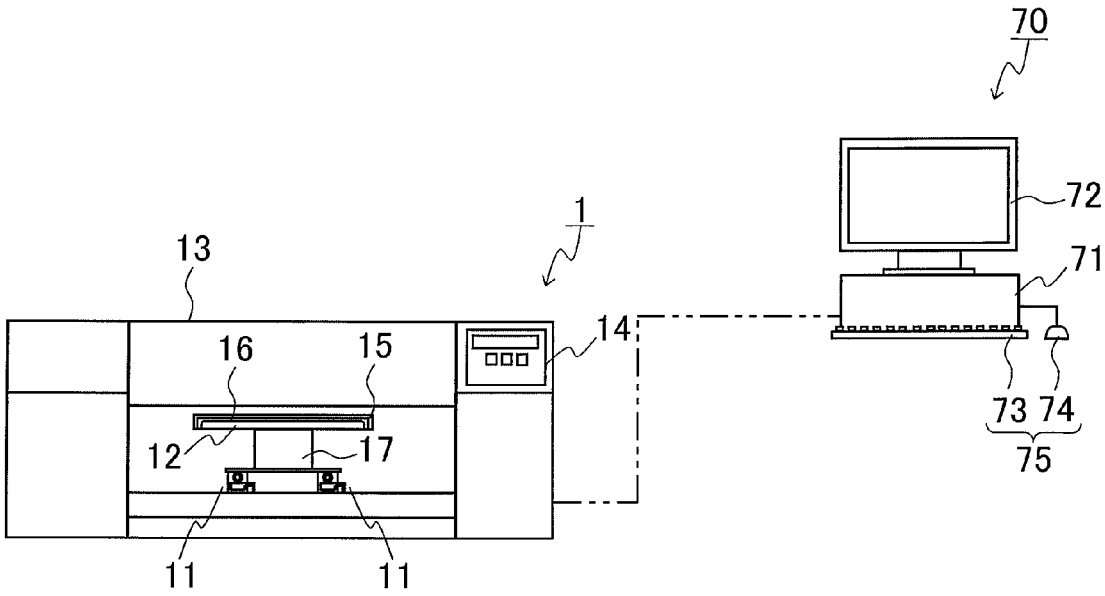
FIG. 2 is a schematic diagram showing an example of the configuration of an ink-jet recording apparatus.

The image printing step may be performed using, for example, the ink-jet recording apparatus shown in FIGS. 2 to 4B. In FIGS. 2 to 4B, identical parts are indicated with identical numerals and symbols. As shown in FIG. 2, the ink-jet recording apparatus comprises an ink-jet printer 1 and a printing control device 70, which are connected through an interface. The ink-jet printer 1 prints a desired image on fabric by ejecting an ink. The printing control device 70 receives image data of the desired image and controls the ink-jet printer 1.

Figure 3:
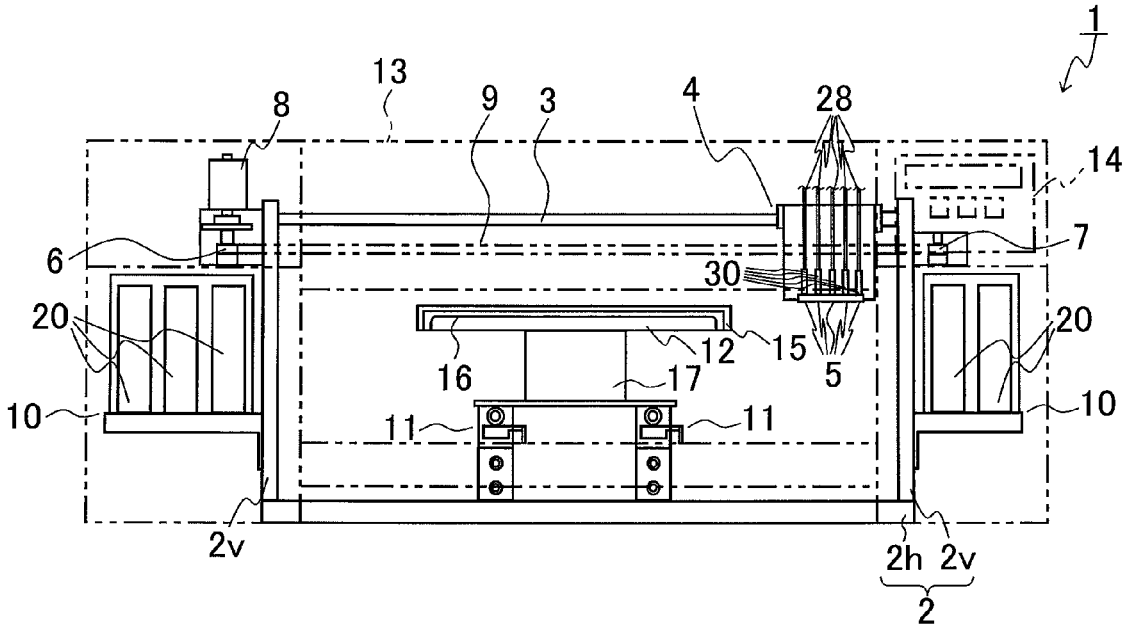
FIG. 3 is a front view showing an example of the configuration of an ink-jet printer of the ink-jet recording apparatus.

As shown in FIG. 3, the ink-jet printer 1 is provided with a frame 2. The frame 2 includes a horizontal portion 2*h* disposed on the bottom of the printer 1 and two vertical portions 2*v* extending perpendicularly to and upward from the respective ends of the horizontal portion 2*h*.

A slide rail 3 is horizontally disposed in such a manner that the upper portions of the respective vertical portions 2*v* are mutually connected. A carriage 4 is mounted on the slide rail 3 slidably in a longitudinal direction (main scanning direction) of the slide rail 3. Five piezoelectric ink-jet heads (ink ejecting units) 5 are provided on the lower surface of the carriage 4, one head being disposed for one of five colors in order to eject ink of that color.

Pulleys 6 and 7 are supported on the upper portions of the respective vertical portions 2*v*, and a motor shaft of a motor 8 supported by the vertical section 2*v* is coupled to one of the pulleys 6. An endless belt 9 is extended between the pulleys 6 and 7, and the carriage 4 is fixed to an appropriate portion of the endless belt 9.

By means of the foregoing configuration, the carriage 4 reciprocates linearly along the longitudinal direction (main scanning direction) of the slide rail 3 as the motor 8 rotates the pulley 6 in the normal or reverse direction, and consequently the ink-jet heads 5 reciprocate.

Each vertical portion 2*v* is provided with a mounting portion 10, on which ink tanks 20 are detachably mounted. A first mounting portion 10 is arranged to hold two ink tanks 20 each containing different color ink and a second mounting portion 10 is arranged to hold three ink tanks 20 each containing different color ink. Each ink tank 20 includes an ink bag (not shown) therein. The ink bags of the ink tanks 20 are respectively connected, through flexible tubes 28, to five sub tanks 30 disposed on the upper portions of the respective inkjet heads 5. The sub tanks 30 are in communication with the respective inkjet heads 5 as described below. Thus inks are supplied from the ink tanks 20 to the respective ink-jet heads 5.

A slide mechanism 11 is provided on the horizontal portion 2*h* of the frame 2. The slide mechanism 11 supports a platen (support) 12. The platen 12 is provided with a fixing frame (fixing unit) 15 so that fabric is set on the platen 12 with the printing side (the side on which an image to be printed) up and is set in a flat state without creases. The ink-jet printer 1 of this embodiment performs ink-jet printing on a T-shirt that has been sewed. However, the ink-jet printer 1 may be applied to fabric in general. Further, in the ink-jet printer 1 of this embodiment, the number of the platens 12 is one. However, the number of the platens is not limited to one and may be more if necessary. For example, when the ink-jet printer is provided with two platens, fixation of a T-shirt to one of the platens may be performed while an image is printed on another T-shirt fixed on the other of the platens. Thereby, working efficiency may be increased.

Further, a platen moving mechanism (not shown) is provided in order to reciprocate the platen 12 in a direction perpendicular to the paper surface in FIG. 3 (the sliding direction of the slide mechanism 11, which forms an auxiliary scanning direction of the ink-jet printer 1). A rack and pinion mechanism, a mechanism using an endless belt, or the like may be employed for the platen moving mechanism.

Figure 4A:
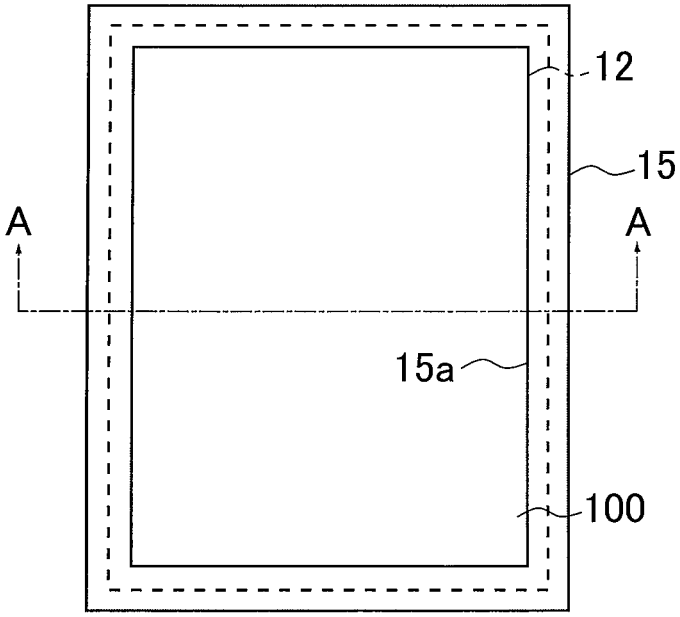
FIG. 4A is a plan view showing the state where fabric is set on a platen of the ink-jet recording apparatus.
Figure 4B:
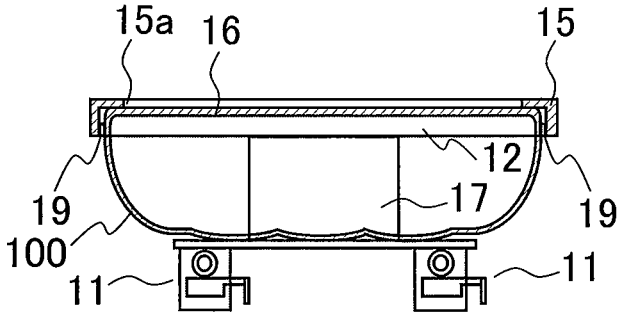
FIG. 4B is a cross sectional view taken along the line A-A of FIG. 4A.

As shown in FIGS. 4A and 4B, the platen 12 is a rectangle having the longitudinal direction in a direction orthogonal to the reciprocating direction of the carriage 4 from the planar view. The platen 12 includes a support surface 16 that supports a T-shirt 100. Further, a part of the lower surface of the platen 12 at the farthest side in a direction perpendicular to the paper surface in FIG. 4B is connected to the slide mechanism 11 at the corresponding position through a support member 17. Further, each of the longitudinal sides of the platen 12 has an arc shaped upper end.

The fixing frame 15 has an L-shaped cross section and the frame covers the four sides of the support surface 16 of the platen 12. The fixing frame 15 includes, at the side facing the support surface 16 of the platen 12, an opening portion 15*a* having an opening area slightly smaller than the area of the support surface 16 of the platen 12. Further, the fixing frame 15 includes, at the inner surface facing the side surface of the platen 12, an antiskid member 19 made of rubber. In the case where the T-shirt 100 is set on the platen 12, the antiskid member 19 allows the T-shirt 100 to be set stretching in two directions, i.e., the longitudinal direction of the support surface 16 (the longitudinal direction of the T-shirt 100) and the lateral direction of the support surface 16 (the lateral direction of the T-shirt 100), and thus the T-shirt 100 is held without creases. At the time of setting the T-shirt 100 on the platen 12, the T-shirt 100 is set from the hem side in such a manner that the T-shirt covers the support surface 16 of the platen 12 and is fixed with the fixing frame 15. Further, the fixing frame 15 is provided rotatably by means of a rotation portion (not shown) provided at the end portion of the platen 12 positioned at the farthest side in a direction perpendicular to the paper surface in FIG. 4B. The T-shirt 100 is fixed between the platen 12 and the fixing frame 15 by rotating the fixing frame 15 so as to fit to the platen 12 after covering the platen 12 with the T-shirt 100.

The ink-jet printer 1 is provided with a cover 13. The cover 13 covers the ink-jet heads 5, the slide mechanism 11, and the like to protect them. It is to be noted that the cover 13 is illustrated by chain double-dashed lines, so that the configuration inside the cover 13 is shown in detail in FIG. 3. The cover 13 is provided with, at the upper right-hand portion of the front side thereof, an operation panel 14, which includes a liquid crystal panel and operation buttons.

The five ink-jet heads 5 shown in FIG. 3 of respective five inks (white, yellow, magenta, cyan, and black) are provided along the reciprocating direction of the carriage 4. The ink-jet heads 5 are connected to respective ink tanks 20 through the flexible tubes 28 and the sub tanks 30. As the configuration for supplying an ink to an ink-jet head, a conventionally known configuration may be employed (see JP 2004-291461 A, for example).

By connecting the ink tanks 20 to the sub tanks 30 through the flexible tubes 28, it is possible to supply inks in the ink tanks 20 to the respective sub tanks 30 and to provide the ink tanks 20 at places where they are easily changeable. Therefore, when inks in the ink tanks 20 run out, the ink tanks 20 may easily be changed.

Each of the ink-jet head 5 is provided in such a manner that a clearance is formed between the lower surface thereof and the support surface 16 of the platen 12. An area to be printed of the T-shirt 100 that is set on the platen 12 is fed into the clearance at the time of printing an image on the T-shirt 100. According to the foregoing configuration, by reciprocating the ink-jet heads 5 by the carriage 4 while ejecting each of the color inks from plural ejection nozzles with micro-diameters formed on the bottom surfaces of the ink-jet heads 5 on the T-shirt 100, a desired color image is printed on the T-shirt 100.

The printing control device 70 shown in FIG. 2 is composed of a general-purpose personal computer (PC), for example. The printing control device 70 is provided with a body 71, a display serving as a display portion 72, a keyboard 73, and a mouse (pointing device) 74. The keyboard 73 and the mouse 74 both serve as an operation portion 75.

Figure 5:
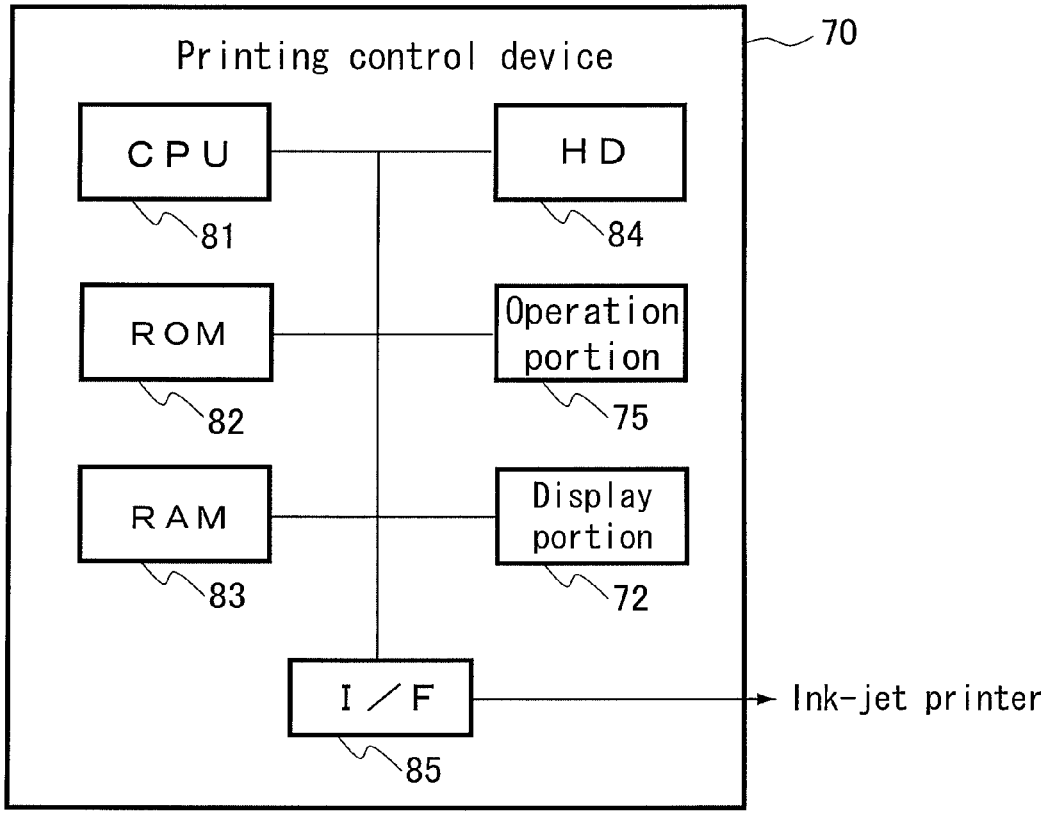
FIG. 5 is a block diagram showing the configuration of the ink-jet recording apparatus.

As shown in FIG. 5, the printing control device 70 is provided with a central processing unit (CPU) 81, a read only memory (ROM) 82, a random access memory (RAM) 83, a hard disk (HD) 84, an operation portion 75, a display portion 72, and an interface (I/F) 85, and they are mutually connected through buses. The CPU 81, the ROM 82, the RAM 83, and the HD 84 are installed inside of the body 71 of the printing control device 70, and the operation portion 75 is composed of the keyboard 73 and the mouse 74.

Various programs used for controlling operations of the printing control device 70 are stored in the HD 84. Further, various data for image and various data for every fabric such as a T-shirt created by software are stored in the HD 84. The CPU 81 performs various computations and processing on the basis of signals inputted by the operation portion 75 and the various programs and data stored in the ROM 82, the RAM 83, and the HD 84. Then, the CPU 81 sends data to the ink-jet printer 1 through the interface 85. The RAM 83 is a readable and writable volatile memory that stores results of the various computations performed by the CPU 81. The interface 85 is connected to the interface of the ink-jet printer 1 and allows communication between the printing control device 70 and the ink-jet printer 1.

Figure 6:
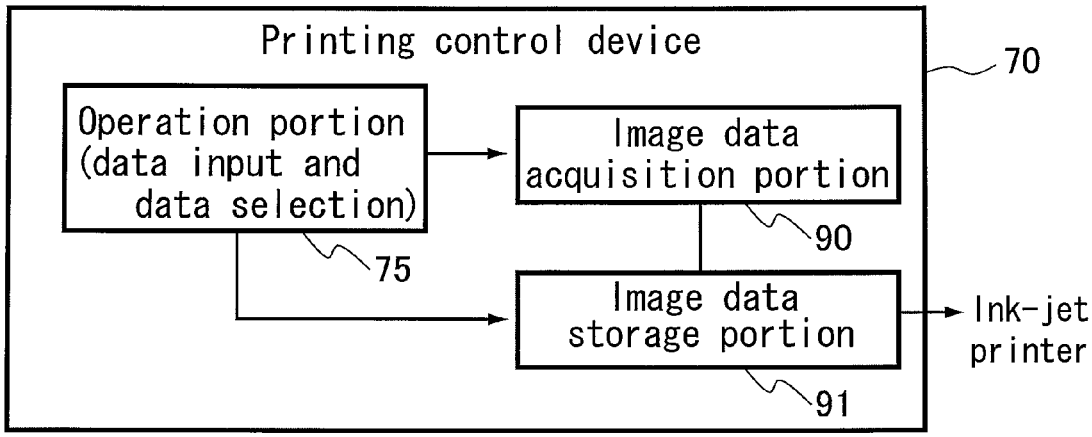
FIG. 6 is a block diagram showing the function of the ink-jet recording apparatus.

As shown in FIG. 6, the printing control device 70 is provided with an image data acquisition portion 90 and an image data storage portion 91. In this embodiment, the image data acquisition portion 90 is implemented by the CPU 81 and the image data storage portion 91 is composed of the RAM 83 or the HD 84.

The image data acquisition portion 90 has a known function for creating image data and creates various image data on the basis of signals inputted by an operator through the keyboard 73 and the mouse 74. The image data storage portion 91 stores image data collected from internet or removable storage media such as CD-ROM, FD, MO, and the like. Further, data storage portion 91 stores image data acquired by the image data acquisition portion 90.

Printing of a desired image on the T-shirt 100 using the ink-jet recording apparatus of this embodiment is performed, for example, as follows. First, image data desired to be printed on the T-shirt 100 is acquired through the keyboard 73 and the mouse 74 of the PC. Acquisition of the image data may be performed by creating image data using software installed in the PC or selecting image data preliminarily stored in the HD 84.

Next, the T-shirt 100 is fixed on the platen 12. Specifically, the T-shirt 100 is set on the platen 12 from the hem side in such a manner that the platen 12 is covered with the T-shirt 100 along the support surface 16 thereof and the T-shirt 100 is fixed with the fixing frame 15 without creases.

Then, when an operator provides an instruction to perform printing, the image data is sent to the ink-jet printer 1 through the interface 85 and inks are ejected from the ink-jet heads 5 on the basis of the image data. Accordingly, printing is performed on the T-shirt 100 fixed on the platen 12.

The ink-jet recording apparatus may further comprise a treatment agent storage portion and a treatment agent ejection unit. The treatment agent storage portion stores the treatment agent therein and the treatment agent ejection unit ejects the treatment agent. The configuration for supplying the treatment agent to the treatment agent ejection unit may be the same as that for supplying inks to the ink-jet heads.

The ink-jet recording apparatus may further comprise a heating mechanism. The heating mechanism is applicable as long as it performs the heat-fixing step in the ink-jet recording apparatus that will be described below. The heating mechanism may be, for example, hot pressing or the like, that applies heat and pressure to a printed area. Alternatively, the ink-jet recording apparatus may further comprise a pressurizing mechanism besides the heating mechanism. The order of the heating and the pressurizing is not particularly limited and either one of them may be performed prior to the other or both of them may be performed simultaneously.

The image printing step is performed by ink-jet recording in this embodiment. The image printing step may be performed by screen printing, gravure printing, stenciling, or the like using a conventionally known device or mechanism.

Heat-Fixing Step

The heat-fixing step is a step of heat-fixing the ink on the fabric by heat-treating the printed area. The heat-fixing step may be performed using the same devices as those used in the heat-treatment step under the same conditions as those of the heat-treatment step. Further, the heat-fixing step may be performed using the device disclosed in JP 2009-209493 A. When the device disclosed in JP 2009-209493 A is used, heat of 180° C. and pressure are applied to the fabric.

EXAMPLES

Next, Examples of the present invention will be described. However, the present invention is neither limited nor restricted by the following Examples.

(Preparation of Treatment Agent)

Treatment agents 1 to 11 were obtained by mixing their composition components (Table 1) uniformly.

TABLE 1

| | Treatment agent | | | | | | | | | | |
|---|---|---|---|---|---|---|---|---|---|---|---|
| | 1 | 2 | 3 | 4 | 5 | 6 | 7 | 8 | 9 | 10 | 11 |
| Component A (Danfixe ® -303 (*1)) (wt %) | 0.5 | 0.5 | 0.5 | — | — | — | — | — | — | — | 0.5 |

TABLE 1-continued

| | Treatment agent | | | | | | | | | | |
|---|---|---|---|---|---|---|---|---|---|---|---|
| | 1 | 2 | 3 | 4 | 5 | 6 | 7 | 8 | 9 | 10 | 11 |
| Component B (Danfix ® -PAA (*2)) (wt %) | 0.1 | 0.2 | 0.3 | 0.3 | 0.5 | 1 | 2 | 4 | 7 | 9.5 | — |
| Pure water | Balance | Balance | Balance | Balance | Balance | Balance | Balance | Balance | Balance | Balance | Balance |

(*1): produced by Nitto Boseki Co., Ltd.
(*2): produced by Nitto Boseki Co., Ltd.

(Preparation of Water-Based Color Ink)

20 wt % of each of four pigments that will be described below was stirred for 30 minutes or longer so as to be dispersed in 10 wt % of diethylene glycol and 70 wt % of ion-exchange water using a disperser (Sand Grinder, produced by Igarashi Kikai), and thereby obtained pigment dispersion. A water-soluble resin emulsion (acrylic resin, product name: Joncryl 1674 (solid content: 45%), produced by Johnson Polymer Corporation), polyethylene glycol (PEG, molecular weight: 400), and diethylene glycol (DEG, molecular weight: 106) were added to each of the pigment dispersion so that the resultant has the water-based ink composition that will be described below. Each of the resultant mixtures was stirred for 5 minutes, and then pressure-filtrated with a 3-μm membrane filter or a 5-μm metal filter. Thereby, a water-based yellow ink, a water-based magenta ink, a water-based cyan ink, and a water-based black ink were obtained.

(Pigment)

Water-based yellow ink: C. I. Pigment Yellow 74
Water-based magenta ink: C. I. Pigment Red 122
Water-based cyan ink: C. I. Pigment Blue 15:3
Water-based black ink: C. I. Pigment Black 7

Water-Based Color Ink Composition

| | |
|---|---|
| Pigment | 4 wt % |
| Water-soluble resin emulsion | 8 wt % (solid content concentration) |
| Polyethylene glycol (PEG) | 5 wt % |
| Diethylene glycol (DEG) | 15 wt % |
| Ion-exchange water | Balance |

(Note that the pigment concentration of a water-based black ink is 8 wt %)

(Preparation of Water-Based White Ink)

[Preparation of Polymer Dispersant Solution]

<Preparation of Polymer Dispersant Solution 1>

25 parts by mass of a solid acrylate-n-butyl acrylate-benzyl methacrylate-styrene copolymer having a glass-transition temperature of 40° C., a mass-average molecular weight of 10,000, and an acid value of 150 mg KOH/g was dissolved in a mixture of 3.2 parts by mass of sodium hydroxide and 71.8 parts by mass of water, and thereby obtained a polymer dispersant solution 1 having a resin solid content of 25 mass %.

[Preparation of White Ink Base]

<Preparation of White Ink Base 1>

19 parts by mass of water was added to 36 parts by mass of the polymer dispersant solution 1 and mixed to prepare resin varnish for titanium dioxide dispersion. Then, 45 parts by mass of titanium dioxide (CR-90, alumina-silica treatment (alumina/silica≥0.5), average primary particle size: 0.25 μm, oil absorption: 21 mL/100 g, produced by ISHIHARA SANGYO KAISHA, LTD.) was added to the resin varnish and then stirred. Thereafter, the resultant was milled with a wet circulation mill and thereby obtained a white ink base 1 (titanium dioxide/dispersant=1/0.2 (mass ratio)).

[Preparation of Water-Based White Ink]

<Preparation of Water-Based White Ink>

40 parts by mass of an anionic acrylic resin emulsion having a glass-transition temperature of −38° C. (product name: Mowinyl 952, produced by Nichigo-Mowinyl Co., LTD., solid content: 45 mass %), 15 parts by mass of glycerin, 1 part by mass of Acetylenol E100 (ethylene oxide adduct of acethylene glycol, produced by Kawaken Fine Chemicals Co., Ltd.), and 10.7 parts by mass of water were added to 33.3 parts by mass of the white ink base 1 and then mixed by stirring to prepare a water-based white ink.

Example 1

A color image was formed on a white polyester T-shirt with the treatment agent 1 and the water-based color inks by the following steps.

(Treatment Step)

The treatment agent 1 was sprayed on an image forming side of the T-shirt.

(Heat-Treatment Step)

After the treatment step, by hot-pressing the T-shirt with a hot pressing machine set at 180° C., the treatment agent 1-applied area of the T-shirt was heat-treated. Thereby, the treatment agent 1-applied area was dried and compressed.

(Image Printing Step)

After the heat-treatment step, a color image was printed on the treatment agent 1-applied area by ejecting the water-based color inks to the T-shirt using the ink-jet recording apparatus shown in FIG. 2.

(Heat-Fixing Step)

After the image printing step, by hot-pressing the T-shirt with a hot pressing machine set at 180° C., the printed area of the T-shirt was heat-treated. Thereby, the water-based color inks were heat-fixed on the T-shirt and the printing area was pressurized.

Examples 2 to 11

Color images were formed on the T-shirts in the same manner as in Example 1 except that the treatment agents 2 to 11 were used.

Example 12

A color image was formed on a black polyester T-shirt with the treatment agent 4, the water-based white ink, and the water-based color inks by the following steps.

(Treatment Step)

The treatment agent 4 was sprayed on an image forming side of the T-shirt.

(Heat-Treatment Step)

After the treatment step, by hot-pressing the T-shirt with a hot pressing machine set at 180° C., the treatment agent 4-applied area of the T-shirt was heat-treated. Thereby, the treatment agent 4-applied area was dried and compressed.

(Image Printing Step)

After the heat-treatment step, a base area was formed on the treatment agent 4-applied area by ejecting the water-based white ink to the T-shirt using the ink-jet recording apparatus shown in FIG. 2. Subsequently, a color image was printed on the base area by ejecting the water-based color inks to the T-shirt using the ink-jet recording apparatus shown in FIG. 2.

(Heat-Fixing Step)

After the image printing step, by hot-pressing the T-shirt with a hot pressing machine set at 180° C., the printed area of the T-shirt was heat-treated. Thereby, the water-based white ink and the water-based color inks were heat-fixed on the T-shirt and the printing area was pressurized.

Example 13

A color image was formed on the T-shirt in the same manner as in Example 12 except that the treatment agent 3 was used.

Example 14

A color image was formed on a black polyester T-shirt with the treatment agent 11, the water-based white ink, and the water-based color inks by the following steps. First, a pretreatment step was performed as follows. A treatment agent obtained by diluting a pretreatment agent, GC-51P2L (concentration type) produced by Brother Industries, Ltd., with pure water of the equivalent amount was sprayed on an image forming side of the T-shirt. Then, by hot-pressing the T-shirt with a hot pressing machine set at 180° C., the treatment agent-applied area of the T-shirt was heat-treated. Thereby, the treatment agent-applied area was dried and compressed. After the pretreatment step, a color image was formed on the T-shirt in the same manner as in Example 12 except that the treatment agent 11 was used.

Example 15

A color image was formed on the T-shirt in the same manner as in Example 14 except that the treatment agent 4 was used.

Example 16

A color image was formed on the T-shirt in the same manner as in Example 14 except that the treatment agent 3 was used.

With respect to Examples 1 to 11, (a) evaluation of color developing properties, (b) evaluation of washing fastness, and (c) evaluation of yellowing were made according to the following methods.

(a) Evaluation of Color Developing Properties

By comparison to a blank in which an image was formed without performing the treatment step, the color developing properties were visually evaluated according to the following evaluation criteria.

Evaluation Criteria for Color Developing Properties Evaluation

AA: The color developing properties were very superior to those of the blank.

A: The color developing properties were superior to those of the blank.

C: The color developing properties were comparable or inferior to those of the blank.

(b) Evaluation of Washing Fastness

A T-shirt having a color image was washed for 5 times according to the AATCC test method 135-2004 IIIA or a T-shirt having a color image was washed using a bucket washing machine for 15 minutes twice. Then, the washing fastness was evaluated according to the following evaluation criteria.

Evaluation Criteria for Washing Fastness Evaluation

AA: The washing fastness of the T-shirt after washing according to the AATCC test method 135-2004 IIIA was 4-grade or higher on average according to the rating of Japan Dyer's Inspection Institute Foundation, or the washing fastness of the T-shirt after bucket washing was comparable level thereto.

A: The washing fastness of the T-shirt after washing according to the AATCC test method 135-2004 IIIA was 3-grade or higher on average according to the rating of Japan Dyer's Inspection Institute Foundation, or the washing fastness of the T-shirt after bucket washing was comparable level thereto.

C: The washing fastness of the T-shirt after washing according to the AATCC test method 135-2004 IIIA was lower than 3-grade on average according to the rating of Japan Dyer's Inspection Institute Foundation, or the washing fastness of the T-shirt after bucket washing was comparable level thereto.

(c) Evaluation of Yellowing

By comparison of a treatment agent-applied area and a treatment agent-non applied area of the T-shirt after the heat-treatment step, the yellowing was visually evaluated according to the following evaluation criteria.

Evaluation Criteria for Yellowing Evaluation

AA: No yellowing was observed at the treatment agent-applied area.

A: The yellowing was observed at the treatment agent-applied area when looking closely.

B: The yellowing was observed at the treatment agent-applied area but was an acceptable level in practical use.

With respect to Examples 12 to 16, (a) evaluation of color developing properties and (b) evaluation of washing fastness were made in the same manner as in Examples 1 to 11. A blank used for the evaluation of color developing properties in Examples 14 to 16 was not applied with the pretreatment neither. Further, with respect to Examples 12 to 16, (d) evaluation of a mark of a treatment agent (yellowing and glossiness) and (e) evaluation of whiteness were made according to the following methods.

(d) Evaluation of Mark of Treatment Agent

By comparison of a treatment agent-applied area and a treatment agent-non applied area of the T-shirt after the heat-treatment step, the mark of the treatment agent (yellowing and glossiness) was visually evaluated according to the following evaluation criteria.

Evaluation Criteria for Mark of Treatment Agent

AA: No mark of the treatment agent was observed at the treatment agent-applied area.

A: The mark of the treatment agent was observed at the treatment agent-applied area when looking closely.

B: The mark of the treatment agent was observed at the treatment agent-applied area but was an acceptable level in practical use.

(e) Evaluation of Whiteness

With respect to the T-shirt on which a color image was formed, the whiteness (L value) of an area of the base area on which the color inks were not ejected and therefore was not overlapped with the color image was measured using a spectrodensitometer, X-Rite 939, produced by X-Rite.

The results of the evaluations of Examples 1 to 11 and the blank are summarized in Table 2. Further, the results of the evaluations of Examples 12 to 16 and the blank are summarized in Table 3.

TABLE 2

| | Examples | | | | | | | | | | | |
|---|---|---|---|---|---|---|---|---|---|---|---|---|
| | 1 | 2 | 3 | 4 | 5 | 6 | 7 | 8 | 9 | 10 | 11 | Blank |
| Treatment agent | 1 | 2 | 3 | 4 | 5 | 6 | 7 | 8 | 9 | 10 | 11 | — |
| Color developing properties evaluation | AA | AA | AA | A | AA | AA | AA | AA | AA | AA | AA | — |
| Washing fastness evaluation | A | A | AA | A | AA | AA | AA | AA | A | A | A | C |
| Yellowing evaluation | A | A | A | A | B | B | B | B | B | B | AA | AA |

TABLE 3

| | Examples | | | | | |
|---|---|---|---|---|---|---|
| | 12 | 13 | 14 | 15 | 16 | Blank |
| Treatment agent | 4 | 3 | 11 | 4 | 3 | — |
| Pretreatment step | — | — | Performed | Performed | Performed | |
| Color developing properties evaluation | A | A | A | A | A | — |
| Washing fastness evaluation | A | A | AA | AA | AA | A |
| Treatment agent mark evaluation | A | A | A | A | A | A |
| Whiteness evaluation | 41.6 | 35.5 | 53.6 | 58.3 | 57.7 | 25.5 |

As summarized in Table 2, as compared to the blank, Examples 1 to 11 showed favorable results in the color developing properties evaluation and the washing fastness evaluation. Further, even when the yellowing was observed at the treatment agent-applied area, it was an acceptable level in practical use. As summarized in Table 3, Examples 12 to 16 in which a color image was formed on a black polyester T-shirt showed favorable results in the color developing properties evaluation, the washing fastness evaluation, and the treatment agent mark evaluation since a color image was printed on the base area with color inks after forming a base area on the treatment agent-applied area with a white ink. Particularly, Examples 14 to 16 in which the pretreatment step was performed showed the higher washing fastness.

It will be obvious to those having skill in the art that many changes may be made in the above-described details of the particular aspects described herein without departing from the spirit or scope of the invention as defined in the appended claims.

What is claimed is:

1. An image forming method for forming an image on fabric, comprising:

a treatment step of applying a treatment agent on fabric;

an image printing step of printing an image on a treatment agent-applied area with an ink; and a heat-fixing step of heat-fixing the ink on the fabric, wherein the treatment agent used in the treatment step comprises a mixture of an allylamine-diallylamine copolymer and sodium chloride.

2. The method according to claim 1, wherein a material of the fabric is synthetic fiber.

3. The method according to claim 1, wherein a material of the fabric is polyester.

4. The method according to claim 1, wherein the ink used in the image printing step comprises a pigment.

5. The method according to claim 1, further comprising at least one of the following step a and the following step b:

Step a: a heat-treatment step of heat-treating the treatment agent-applied area to dry Step b: a compression step of compressing the treatment agent-applied area.

6. The method according to claim 1, wherein the treatment step is performed prior to the image printing step.

7. The method according to claim 1, wherein the image printing step is performed by ink-jet recording.

8. The method according to claim 1, wherein the image printing step comprises:

a base area forming step of forming a base area on the treatment agent-applied area with a first ink; and an image printing step of printing an image on the base area with a second ink.

9. The method according to claim 8, wherein a white ink is used as the first ink.

10. The method according to claim 8, wherein a color ink is used as the second ink.

11. The method according to claim 1, wherein an amount of the mixture of allylamine-diallylamine copolymer and sodium chloride in the treatment agent used in the treatment step is about 0.3 wt % relative to a total amount of the treatment agent.

12. A producing method for producing fabric having an image, comprising a step of forming an image on since a color image was printed on the base area with color inks after forming a base area on the treatment agent-applied area with a white ink fabric by the image forming method according to claim 1.

13. The method according to claim 1, wherein the mixture of allylamine-diallylamine copolymer and sodium chloride is present in an amount of ≤ about 10 wt. % relative to a total amount of the treatment agent.

14. The method according to claim 1, wherein the treatment agent further comprises a diallyldimethylammonium chloride-sulfur dioxide copolymer.

15. The method according to claim 14, wherein an amount of diallyldimethylammonium chloride-sulfur dioxide copolymer in the treatment agent is about 0.5 wt. % relative to a total amount of the treatment agent.

16. The method according to claim 14, wherein an amount of the mixture of allylamine-diallylamine copolymer and sodium chloride in the treatment agent is ≤ about 10 wt. %; and wherein an amount of diallyldimethylammonium chloride-sulfur dioxide copolymer in the treatment agent is ≤ about 10 wt. %, relative to a total amount of the treatment agent.

* * * * *